United States Patent [19]

Johnston et al.

[11] 4,255,633

[45] Mar. 10, 1981

[54] PUSH-PULL SWITCH OPERATOR

[75] Inventors: Robert J. Johnston, Patterson Heights; Stephen G. Layciak, Brighton Township, Beaver County; George M. Cametti, Beaver, all of Pa.

[73] Assignee: Westinghouse Electric Corp., Pittsburgh, Pa.

[21] Appl. No.: 45,449

[22] Filed: Jun. 4, 1979

[51] Int. Cl.[3] ..... H01H 15/24

[52] U.S. Cl. ..... 200/153 J; 200/155 L; 200/18; 200/307

[58] Field of Search ..... 200/4 R, 5 R, 16 A, 200/18, 153 J, 159 R, 156, 307, 328, 153 L, 153 LA, 325, 313

[56] References Cited

U.S. PATENT DOCUMENTS

| | | | |
|---|---|---|---|
| 1,309,840 | 7/1919 | Bramming | 200/159 R |
| 2,946,237 | 7/1960 | Hebert | 200/153 J |
| 2,956,446 | 10/1960 | Ensign et al. | 200/153 J |
| 2,991,343 | 7/1961 | Norden | 200/153 LA |
| 2,996,593 | 8/1961 | McMains | 200/159 R |
| 3,169,406 | 2/1965 | Mullen | 200/16 R |
| 3,288,973 | 11/1966 | Piber | 200/328 |
| 3,312,805 | 4/1967 | Bury | 200/159 R |
| 3,406,589 | 10/1968 | Guber | 200/153 J |
| 3,472,986 | 10/1969 | Stullman | 200/313 |
| 3,582,592 | 6/1971 | Schadow | 200/328 |
| 3,707,610 | 12/1972 | Davies | 200/153 J |
| 3,789,173 | 1/1974 | Bury | 200/153 J |
| 3,808,388 | 4/1974 | Neuschuander | 200/153 J |
| 3,824,362 | 7/1974 | Bury | 200/153 J |
| 3,866,006 | 2/1975 | Westram | 200/153 LA |
| 3,895,205 | 7/1975 | Tharp | 200/340 |
| 4,064,381 | 12/1977 | Mullen et al. | 200/30 |
| 4,112,277 | 9/1978 | Kleeb | 200/159 R |

*Primary Examiner*—John W. Shepperd
*Attorney, Agent, or Firm*—L. P. Johns

[57] ABSTRACT

A push-pull switch operator characterized by separable contacts, a contact operating member, an actuating structure movable longitudinally to move said member, a guide adjacent the actuator for guiding the structure through longitudinal movement, the guide having a cam and the actuating structure having a cam follower, the cam follower being mounted on a spring biased slide for movement transversely of the longitudinal movement of the structure to effect push-pull momentary, push-pull maintained, and pull operation of the switch.

6 Claims, 10 Drawing Figures

PUSH-PULL SWITCH OPERATOR

CROSS-REFERENCE TO RELATED APPLICATIONS

This application is related to the copending applications of Robert J. Johnston, et al., Ser. No. 25,178, filed Mar. 29, 1979; and Robert J. Johnson et al., Ser. No. 29,515, filed Apr. 12, 1979.

BACKGROUND OF THE INVENTION

1. Field of the Invention

This invention relates to a push-pull switch operator and, more particularly, it pertains to an operator having the functions of push-pull momentary, push-pull maintained, and pull only.

2. Description of the Prior Art

Electrical control switches are the subject of innovations to advance the state of the art and to meet challenges of a rapidly growing field of technology. Frequently innovations solve one problem, but create other unexpected disadvantages which in turn generate more development. Recent innovations of push-pull switches have included the provision of a tubular actuator, rather than a solid type in order to provide means for mounting an indicator light. Associated with the foregoing has been a replacement of metal with plastic parts.

SUMMARY OF THE INVENTION

A push-pull switch operator comprising separable switch contacts, a contact operating member, an actuating structure movable longitudinally between first and second positions for reciprocably moving the member, a guide fixedly mounted adjacent to the actuating structure and comprising a cam, a slide plate slidably mounted on the actuating structure and biased in a direction lateral to the longitudinal movement of the actuating structure, a cam following pin on the slide plate, the cam having a camming surface inclined to the longitudinal axis of said structure, and bias means for biasing the cam following pin against the camming surface to effect longitudinal movement of the actuating structure.

The advantage of the device of this invention is that it provides for various push-pull functions including push-pull momentary, push-pull maintained, and pull only, whereby a simple and flexible structure yields a multiplicity of operating functions with a minimum of parts.

DESCRIPTION OF THE PREFERRED EMBODIMENT

Figure 1:
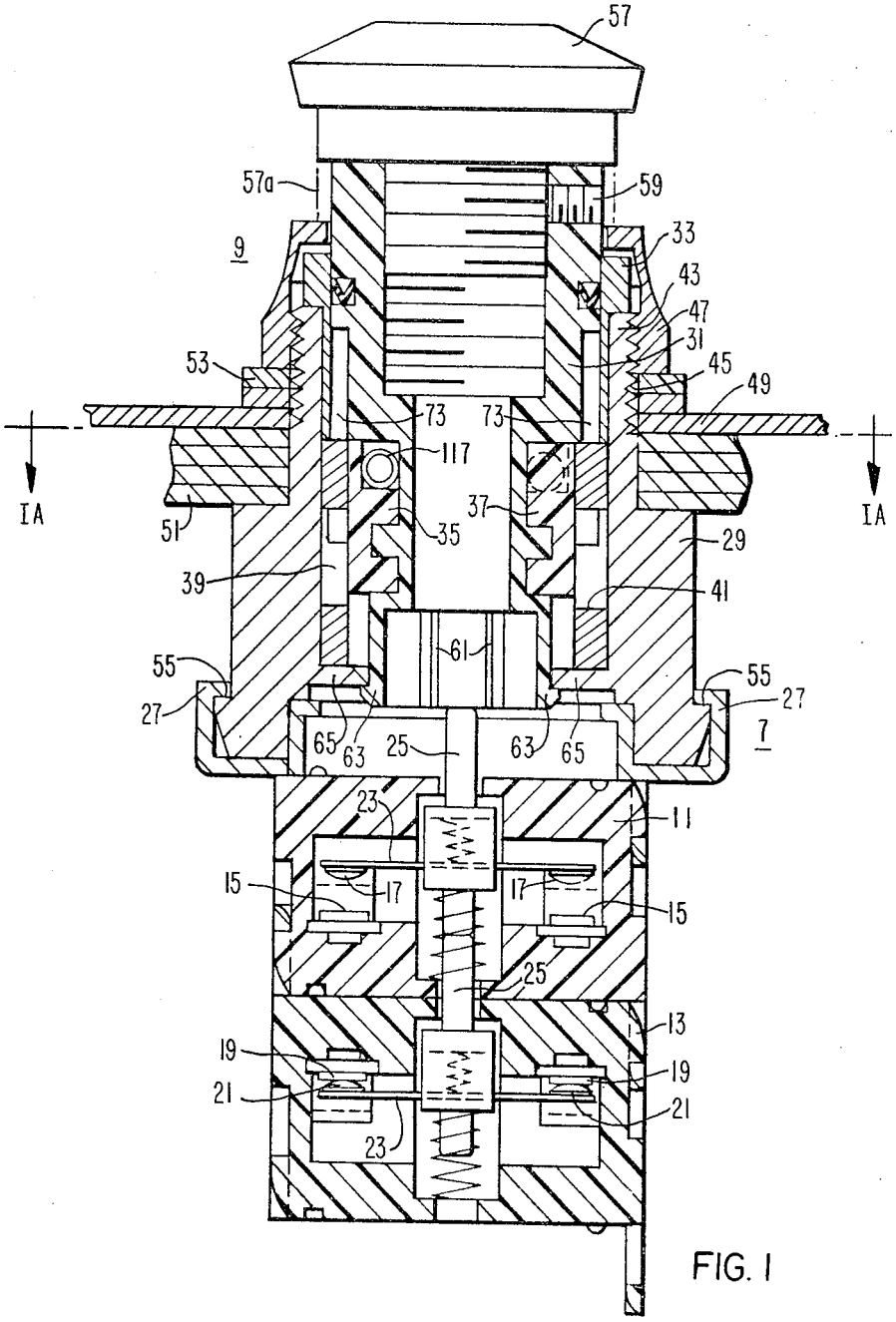
FIG. 1 is a vertical sectional view showing the device of this invention.
Figure 1A:
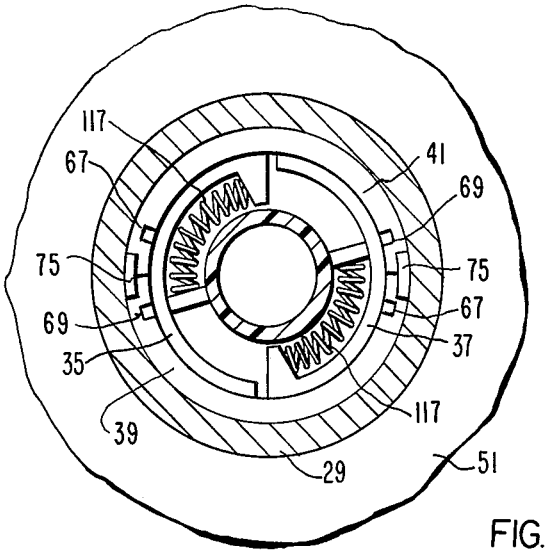
FIG. 1A is a horizontal sectional view taken on the line 1A of FIG. 1.

In FIG. 1 a push-pull switch structure is generally indicated at 7 and it comprises an operator 9 and a plurality of switches 11, 13. Each switch 11, 13 is interchangeable between normally open and normally closed conditions and the switch 11 is shown in the normally open condition with stationary contacts 15 and movable contacts 17 spaced therefrom. Conversely, the switch 13 includes stationary contacts 19 and movable contacts 21 in normally closed positions. Both switches 11, 13 include similar movable contact carrying bridges 23 and reciprocable plungers 25 disposed in end-to-end alignment. The switches are attached to the lower end of the operator 9 by similar hooks 27 such as shown in copending application Ser. No. 7,742, filed Jan. 30, 1979.

The operator 9 comprises a tubular housing 29, a tubular actuator or actuating structure 31, a bushing 33, a pair of slides 35, 37, and a pair of guides 39, 41. The housing 29 has an upper reduced portion 43 which is threaded at 45 for receiving a clamp ring 47, whereby the switch structure 7 is mounted on a panel 49. Gasket means 51 are disposed on one side of the panel 49 and thrust washers 53 are provided on the opposite side. The lower end of the housing 29 includes similar shoulders 55 by which the hooks 27 are secured.

The actuator 31 is slidable longitudinally within the housing 29 where it is secured in place by the bushing 33. A button 57, which is mounted by a set screw 59 in the upper end of the actuator 31 is used for manually pushing or pulling the actuator longitudinally in the operator 9. The lower end of the actuator 31 has a plurality of peripherally spaced slots 61 and outturned portions 63 which engage an annular flange 65 of the housing 29. When the actuator 31 is pushed downwardly as viewed in FIG. 1, the lower end of the actuator depresses the upper end of the plunger 25 to move the movable contacts 17, 21 within the switches 11, 13.

Figure 5:
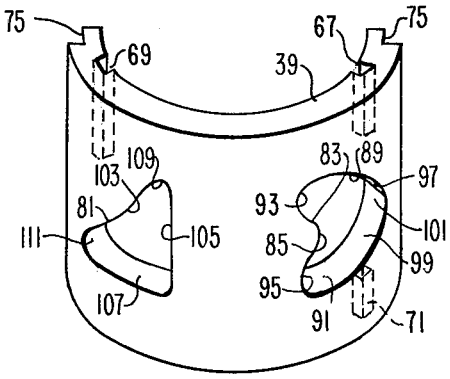
FIG. 5 is an isometric view of the guide.

In accordance with this invention the slides 35, 37 and the guides 39, 41, cooperate to provide the switch structure 7 with the several functions, push-pull momentary, push-pull maintained, and pull only. The guides 39, 41 are disposed between the housing 29 and the actuator 31 with the lower edges resting upon the annular flange 65. The upper edges abut the bushing 33. As shown in FIG. 5 the guide 39 (representative of the guide 41), includes a number of, such as, three key-ways 67, 69, 71 on the surface adjacent the actuator 31 in which keys 73 (FIGS. 1, 2), on the actuator are slidably located. Both guides 39, 41 are provided with similar vertical notches 75 (FIG. 5) which interfit diametrically opposite guide ribs 77 on the inner surface of the housing 29.

Figure 2:
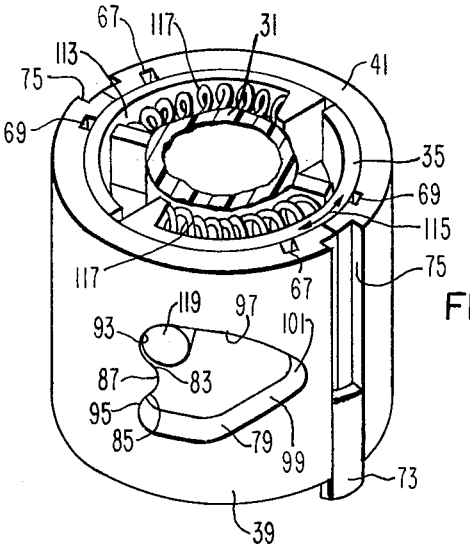
FIG. 2 is an isometric view of the actuator and guide in the push-pull two-position maintained.

The guide 39 also comprises (FIG. 5) a cam notch 79 and a cam notch 81 which are used alternately depending upon the purpose of the operator 9. The cam notch 79 (FIG. 2) comprises a pair of camming surfaces 83, 85 which are inclined at an angle to the longitudinal axis of the operator 9 and which form an apex 87. The notch 79 also includes surfaces 89, 91 which with surfaces 83, 85, respectively form points 93, 95 (FIG. 2). The notch 79 also comprises camming surfaces 97, 99 which are inclined at an angle to the longitudinal axis of the operator 9 and form a point 101.

The cam notch 81 has a triangular configuration including a cam surface 103 (FIG. 4) as well as surfaces 105 and 107. The cam surface 103 forms points 109 and 111 with the surfaces 105, 107, respectively.

Figure 2A:
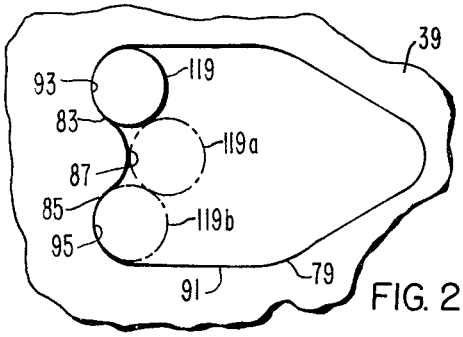
FIG. 2A is an elevational view of the cam notch.

The slides 35, 37 are mounted in an opening 113, such as shown for the slide 35 (FIG. 2), wherein the slide 35 is movable laterally or transversely to the longitudinal axis of the actuator 31, in the direction of the arrow 115. Bias means, such as a coil spring 117, urges the slide 35 toward the left. A cam follower or pin 119 extends outwardly from the slide 35 and extends into the cam notch 79. When the operator 9 is in the completely extended position (FIG. 1) with the outturned portion 63 against the annular flange 65, the pin 119 is in the point 93 of the cam notch 79 (FIG. 2A). When the button 57 is pushed inwardly, the pin 119 rides along the camming surface 83, causing the slide 35 to retract to the right (FIG. 2) against the coil spring 117, until the pin reaches the position 119*a* at the apex 87 of the cam notch 79. If the button 57 is released before the pin 119 reaches the center of the apex 87, the spring 117 drives the pin upwardly along the camming surface 83 to the original position of the pin. On the other hand, if the button 57 pushed beyond the center of the apex 87, the pin 119 moves along the camming surface 85 to the point 95 with the pin in the position 119*b*, thereby maintaining the actuator 31 in the completely depressed position with the button 57 in the position 57*a* (FIG. 1) and the contacts 15, 17 in the closed position and the contacts 19, 21 in the open position.

Figure 3:
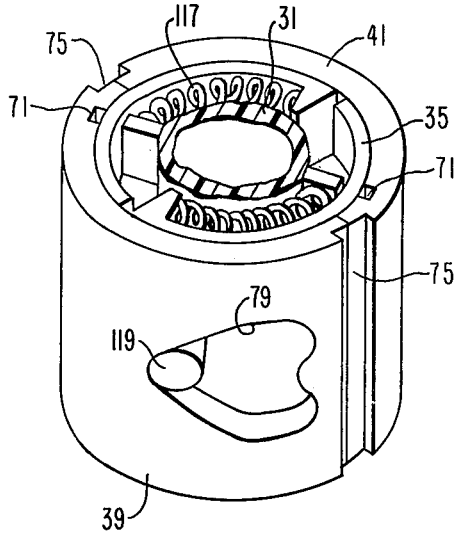
FIG. 3 is an isometric view of the actuator and guide in push-pull momentary with maintained center position.
Figure 3A:
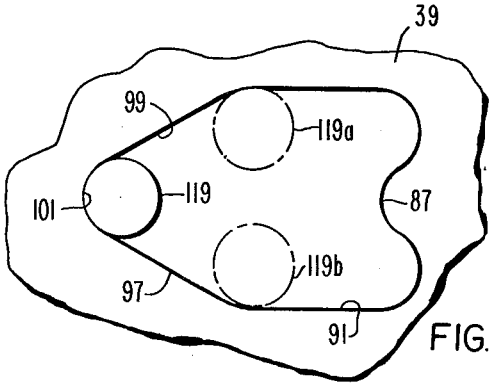
FIG. 3A is an elevational view of the cam notch in a reversed position.

To operate operator 9 in the so-called "push-pull momentary" position (FIG. 3), the button 57 may be either pushed or pulled as necessary. In the position shown in FIGS. 3, 3A the spring 117 holds the pin 119 in the point 101. Pushing in the button 57 causes the pin to move along the cam surface 97 until the pin 119 reaches the position 119*b*. Conversely, pulling the button 57 outwardly causes the pin 119 to move over the camming surface 99 to the position 119*a*. Release of the button 57 with the pin in either position 119*a*, 119*b*, causes the pin 119, under the pressure of the spring 117 to return over the inclined surfaces 97, 99 until the pin reaches the point 101 as shown in FIG. 3A.

Figure 4:
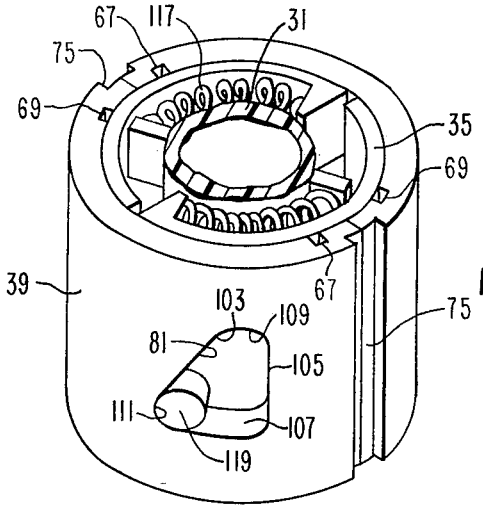
FIG. 4 is an isometric view of the actuator and guide in the pull momentary two-position.
Figure 4A:
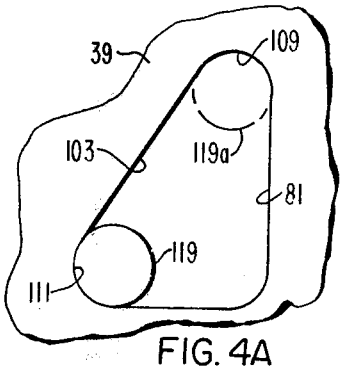
FIGS. 4A and 4B are elevational views in alternate positions.

When it is desirable to operate the switch structure 7 in the so-called "pull momentary" position (FIGS. 4, 4A), the guide 39 is placed in the switch structure 7 in the position shown in FIG. 4 so that the cam notch 81 is operative with the pin 119. In the untouched position the pin 119 is in the point 111 where it is retained by the pressure of the spring 117. When the handle 57 is pulled outwardly the pin 119 rides along the cam surface 103 to the corner 109 (FIG. 4A) with the spring 117 yielding to the greater force applied to the button 57. Thus, the contacts 15-21 are changed to alternate positions. Manifestly, when the button 57 is released by the operator the spring 117 causes the pin 119 to move along the cam surface 103 until the pin reaches the point 111.

Figure 4B:
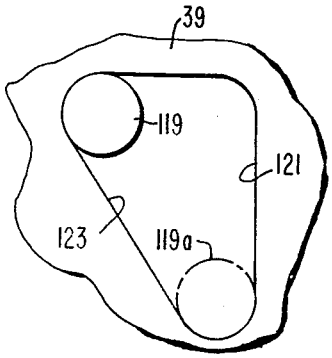

Another embodiment of the cam notch 81 is shown in FIG. 4B in which a cam slot 121 is shown as an inversion of the slot 81 whereby a cam surface 123 is inclined in such a manner as to cause the pin 119 to remain in the upper left corner (FIG. 4B) when the switch structure 7 is unattended, thereby providing a so-called "push only" operation for the switch structure 7. For that purpose, however, a guide 39 having the slot 121 must be provided in addition to the cam notches 79, 81.

Accordingly, the push-pull switch operator of this invention provides for a plurality of switch functions by means of a simple camming action by proper orientation of parts during assembly.

What is claimed is:

1. A push-pull switch operator comprising separable switch contacts, a contact operating member, a housing, an actuating structure movable longitudinally within the housing and between first and second positions for reciprocally moving the member, means resiliently urging said structure toward at least one of the first and second positions between the housing and said structure, the means comprising a collar yieldingly movable in a circumferential path about an outer peripheral surface of said structure, cam surface means fixedly mounted adjacent to the collar, a cam follower on the collar and engaging the cam surface means, the cam having a camming surface inclined to the longitudinal direction of movement of the structure, and bias means for biasing the cam follower against the camming surface to effect longitudinal movement of the structure.

2. The switch operator of claim 1 in which the cam follower is movable in a zone lateral of the longitudinal movement of the structure.

3. The switch operator of claim 2 in which the bias means comprising a spring operatively connected for urging the pin against the camming surface.

4. The switch operator of claim 3 in which the force of the spring moves the actuating structure longitudinally as the pin moves over the cam surface means.

5. The switch operator of claim 4 in which a guide is fixedly mounted adjacent to the actuator structure, and the guide comprises the cam in a position proximate to the pin.

6. The switch operator of claim 5 in which the guide comprises an interfitting part engaging with a corresponding interfitting part on the housing.

* * * * *